United States Patent [19]

Hurwitz et al.

[11] 4,300,959

[45] Nov. 17, 1981

[54] IMPERMEABLE ELECTROFORM FOR HOT ISOSTATIC PRESSING

[75] Inventors: Peter A. Hurwitz, East Hartford; Joseph F. Loersch, Bolton, both of Conn.

[73] Assignee: United Technologies Corporation, Hartford, Conn.

[21] Appl. No.: 68,846

[22] Filed: Aug. 22, 1979

[51] Int. Cl.[3] ..... C22D 1/08; C22D 1/10

[52] U.S. Cl. ..... 148/127; 204/3; 204/9; 204/37 R

[58] Field of Search ..... 148/11.5 Q, 31.5, 127; 428/935, 941; 204/37 R, 37 T, 40, 3, 4, 6, 9; 427/372.2, 374.2, 376.7, 377.8

[56] References Cited

U.S. PATENT DOCUMENTS

| | | | |
|---|---|---|---|
| 1,397,785 | 11/1921 | Rose, Jr. | 204/6 |
| 2,280,865 | 4/1942 | Stössel | 204/6 |
| 2,428,033 | 9/1947 | Wachtman | 204/37 |
| 3,364,064 | 1/1968 | Wijburg | 204/37 R |
| 3,675,311 | 7/1972 | Wells | 29/498 |
| 3,708,866 | | Wells | 29/498 |
| 3,854,194 | 12/1974 | Woodward | 29/494 |
| 4,023,966 | 5/1977 | Loersch | 75/226 |
| 4,065,303 | 12/1977 | Seilstorfer et al. | 75/226 |
| 4,092,448 | 3/1978 | Coll-Palagos | 204/37 R |

OTHER PUBLICATIONS

Hansen, M., *Constitution of Binary Alloys* 2nd Edition, McGraw Hill, pp. 602, 634.

Safranek, W. H., "A Survey of Electroforming For Fabricating Structures", *Plating* vol. 153, No. 10, pp. 1211-1216.

Prine, W. H., "Electroforming Difficult Shapes", *Product Engineering* vol. 19, No. 12, pp. 86-89.

Bell, G. R., "Furnace Fused Spray Metal Coatings" *Papers* 8th International Thermal Spray Conference, American Welding Soc. pp. 396, 400, (1976).

Ballard, E., "Metal Spraying . . . " 4th Ed., pp. 342-343, Griffith, London.

*Primary Examiner*—Michael L. Lewis

*Attorney, Agent, or Firm*—C. G. Nessler

[57] ABSTRACT

A metal electroform suitable for hot isostatic pressing (HIP) of metal powders and the fabrication process therefor is disclosed. Ordinary nickel electroplate is permeable to gases during HIP, e.g., at 1200° C. and 100 MPa. An exemplary improved container is comprised of a first electroplated layer of nickel, a second layer of copper and a third layer of nickel, wherein the container has been heated to about 1150° C. and then cooled, to cause fusing of the second lower melting point layer. During fusing there is limited alloying between the layers, the first and third layers retaining the desired container shape.

3 Claims, 1 Drawing Figure

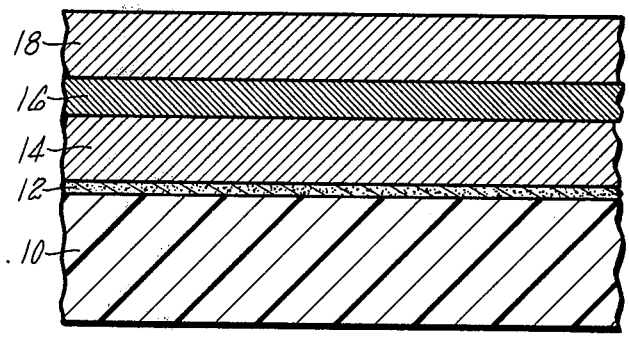
18
16
14
12
10

IMPERMEABLE ELECTROFORM FOR HOT ISOSTATIC PRESSING

BACKGROUND OF THE INVENTION

The present invention relates to the formation of impermeable electroplated metal structures.

The process of forming free-standing articles by means of electroplating is well known. Typically, an electroplate is deposited on a conductive mandrel and subsequently removed therefrom. For example, a cylinder of conductive wax may be covered with an electrodeposit, and then the wax may be melted away to leave a free-standing replica of that cylinder. Electroforming has been used to make duplicating plates, thin-walled sections, precision parts, and parts difficult or impossible to make otherwise. Among the products made are wave guides, pitot tubes, molds and dies for thermoplastics, fine mesh screens, and phonograph record masters.

While many useful objects are made by electroforming, the performance of any particular object will be limited by the properties of the electrodeposit. These properties in turn will be dependent upon the material composition, deposition parameters and any post-deposition processing. A general characteristic of electrodeposits of materials such as nickel, copper and other common metals, is that they are comprised of essentially columnar-type structures. In other electrodeposits a certain degree of crazing or microcracking is present. Both these factors may be found to produce some permeability to gases in electroformed objects.

Electroformed objects would desirably be used as containers in which metal powders may be hot isostatically pressed (HIP). These are often complexly shaped as reflections of the objects being fabricated. Commonly, they are made from nickel or iron base sheet metal of about 1–6 mm thick. After a container is fabricated it is filled with metal powders, evacuated to $10^{-1}$ torr or better and sealed. Then temperature and pressure are applied to the exterior of the container in order to collapse the container and thereby densify the powder contained within. For superalloy powders the parameters would typically be about 100 MPa at 1200° C. for two hours; the container having been evacuated to about $10^{-1}$ torr. After removal from the HIP unit and cooling, the container which is generally diffusion bonded to the powder is usually removed by machining or chemical milling.

Thus, it would seem that it would be a natural application of electroforming to make the expendable HIP containers. But due to the permeability of electroformed containers of materials such as nickel, an adequate vacuum can not be achieved and sustained within the container during the HIP operation.

The invention herein will be seen to relate to differential fusing of layers in electroforms. Melting of thin metal films is commonly encountered in brazing, soldering and the like, wherein a thin layer of meltable material is interposed between two surfaces. Electroplating may be used to place such layers. For example, Wells, U.S. Pat. Nos. 3,675,311 and 3,708,866 disclose a method wherein a thin film of titanium or niobium is used to join nickel. In Woodward, U.S. Pat. No. 3,854,194 a titanium diffusion bonding process is disclosed wherein sequential electroplate layers of nickel, copper, and silver are applied to the surface to be bonded. Of course, the objects of bonding or brazing are quite dissimilar from those involved in forming impermeable structures and HIP containers. In the aforementioned patents and similar joining art, total melting is inherent in the process and electroplating is merely a convenient method of preplacing the layer.

There are also fusible coatings which may be applied to objects by thermal or plasma spraying. Typically, these are hardfacing-type materials; after deposition the coatings are heated by torch or furnace above thin melting points to cause melting and coalescence of the coatings. As deposited sprayed coatings are obviously porous (in contrast to the apparent density of electroplates). Therefore, the object of fusing sprayed coatings is to increase their density, adherence and general properties. While free-standing objects may be made by spraying coatings onto removable mandrels, it should be apparent that if the sprayed object is of a fusible material, it will collapse during the fusion operation.

SUMMARY OF THE INVENTION

An object of the invention is to provide an electroplated structure which is impermeable to gases and which is suitable for providing a container for hot isostatic pressing.

According to the invention, an impermeable metal structure is comprised of a first electroplated layer having a second electroplated layer in intimate contact therewith, the second layer having been fused by heating above its melting point and then cooled. In a preferred embodiment the structure is comprised of a first electroplated layer with a first melting point, a second layer with a second melting point, and a third layer with a third melting point, wherein the first and third melting points are higher than the second melting point and wherein the structure has been heated to a temperature sufficient to melt at least a portion of the second layer but insufficient to cause melting of at least a portion of the first or third layers. Also preferably, the layer which is fused will be at least partially alloyed with a layer in which it is in intimate contact.

Thus, the electroplate layers which do not melt provide dimensional fidelity to the final object while a layer which melts and fuses provides impermeability. An example of the practice of the invention method comprises depositing a nickel electroplate on a conductive wax mandrel, followed by a copper electrodeposit upon the nickel, which is followed by another nickel electrodeposit upon the copper. The mandrel is removed from the electrodeposits and the electrodeposited structure is then heated in a furnace to about 1150° C. for a period of time sufficient to cause the copper to melt. During the fusion step, the nickel electroplates provide structural stability to the object and provide it with an internal configuration substantially matching the original wax mandrel.

The invention provides a metal structure which is impermeable to gases under high differential pressures, compared to an ordinary electroplate. The invention provides an economical container suitable for HIP of metal powders. Containers are readily formed from a variety of materials in various thicknesses to suit the particular application. Thus, the material which is to contact the metal powders during a HIP operation can be chosen so that it is compatible with the metal alloy being consolidated. The fusible layer may be chosen for its melting point and compatibility with adjacent layers. The optional outer layer is generally chosen for the structural contribution it makes.

The foregoing and other objects, features and advantages of the present invention will become more apparent in the light of the following detailed description of preferred embodiments thereof as discussed and illustrated in the accompanying drawing.

BRIEF DESCRIPTION OF THE DRAWING

The drawing shows a three-layer electrodeposit as it is formed on a mandrel having a conductive coating.

DESCRIPTION OF THE PREFERRED EMBODIMENT

The preferred embodiment is described in terms of the fabrication of a HIP container, although it will be seen that the method and article of the invention will be suitable for a multiplicity of other purposes where structures with impermeability to gases are required.

To form objects by hot isostatic pressing of a nickel superalloy powder it is necessary to have a container which is both suitable for the powder and HIP conditions, and impermeable to gases. During HIP the container has a vacuum inside surrounding the powder. A gas such as argon is applied to the exterior of the container at pressures of about 100 MPa or more while it is heated to a temperature in the range of 1250° C. If the container is not properly sealed and impermeable, then the pressure inside the container will rise and there will be adverse results on the powder-formed object. First, inert gas will be physically contained within the powder compact; further, contamination may result if the argon is not perfectly pure. Second, the powder may not be fully consolidated due to the lowering of the differential pressure applied to the container. If the powder is contaminated, the properties of the consolidated powder metal alloy will be degraded; if pressurized inert gas is included within the compact, during subsequent heat treatment at atmospheric pressure the inert gas can expand with the result that porosity is created within the solid metal object. If the object is not fully consolidated, then it will be porous and have low properties. The most common way of checking for a defective HIP container is by first conducting a leak rate check. This is accomplished by measuring the rate at which helium penetrates an evacuated container (using a commercial detector) or by observing the rise in pressure with time while the container is surrounded by 1 atmos- (100 kPa) pressure. For example, a disk-shaped container nominally 60 cm diameter by 5–15 cm long will desirably have a leak rate of 1 to $5\times10^{-3}$ torr per min or less. At times a container may pass the leak rate check and yet leak under the 100 MPa or more pressure and high temperature of the HIP process. Consequently, the ultimate check of a good container is whether a sound metal compact is produced. This is determined by metallographic, mechanical, and chemical testing of the compact. Most significantly, the presence of porosity is observed.

When an electroformed nickel container of about 1–5 mm thick was made using conventional electroplating techniques, and powder was consolidated therein, it was found that the leak rate check was not passed or that porosity resulted. This was repeated in several experiments and even though the nickel electroform was made by conventional processes and was apparently sound according to conventional electroplate inspections, it could be only concluded that the nickel plating was permeable to gases during the HIP process, either due to a minor amount of random but unavoidable pitting or the inherent nature of the electrodeposit.

Consequently, to overcome this problem, that which is now presented as the preferred embodiment of the invention was accomplished. Experimentally, small disk-shaped HIP containers were made and powder metal compacts were made using them, to verify the utility of the new process and article. The invention is illustrated by the drawing, which shows a segment of a wax mandrel with the inventive electrodeposit. The wax mandrel 10 is spray coated with a layer 12 of conductive silver paint to a thickness of about 0.1 mm. Using a commercial sulfamate bath, a first layer 14 of nickel is electrodeposited upon the paint layer to a thickness of about 0.75–1.0 mm. Then a second layer 16 of copper electrodeposit about 0.5–0.75 mm thick is applied using a commercial acid copper bath; this is followed by a third layer 18 of 0.75–1.0 mm thick electrodeposited nickel applied over the copper, using the first bath. The wax mandrel and silver paint are then removed from the three layer electrodeposit structure by heating in the range of 200° C., solvent cleaning, or the combination.

The electrodeposited structure is then heated in a vacuum furnace or other inert atmosphere container to a temperature of about 1100°–1150° C. for about three hours. Of course the melting point of copper is 1083° C. and thus the copper is caused to melt. According to commonly available phase diagrams, it will be seen that there will be some inter-alloying between the copper and nickel under these conditions (i.e., a 5–10 weight percent copper-nickel alloy is formed). It will also be observed that the container preserves substantially the same shape as it had before heat treatment, despite the fact that the contained copper has melted. This can be attributed to the structural support provided by both the inner and outer layers of nickel and the limited alloying attributable to the choices and thicknesses of materials, and heat treating conditions.

A container made according to the above procedure was found to be vacuum tight under the aforementioned HIP conditions for a nickel superalloy and this can be attributed to the melting, alloying, and diffusion that occurred.

The aforementioned container may also be formed with omission of the third layer of nickel, provided the container is adequately supported, as by an internal fixture or contact at an expendable point, to allow the surface layer to properly melt without being attracted to some other supporting surface and thereby creating a defect. Thus, in addition to providing structural strength to the electroform, the third or outer layer may be characterized as providing protection for the second meltable layer while it is liquid.

Alternate methods and layering may be used. The second layer may be applied by some other means than an electroplate, such as plasma spraying. Additional layers may be used: after heat treatment, additional layers may be added to the fused article for structural, corrosion, or other purposes, or additional layers may be added prior to fusion for similar reasons, and more than one melting layer may also be used. Basically, alternate methods other than electroplating for applying the layers would be used for economic reasons, and additional layers would be integrated into the invention article for specialized purposes.

Now describing generally the invention article, the metal structure is comprised of an inner layer with a good fidelity and structural strength for a HIP container but lacking total impermeability to gases. The inner surface of this layer has not been melted. A second layer in intimate contact with the first layer has been heated above its melting point and fused upon cooling to produce an impermeable member in the structure. It is preferable from the standpoint of metallurgical and structural integrity that after heat treatment the melted layer be alloyed with an adjacent unmelted layer or layers. But this is not seen as an absolute requirement, as most articles for HIP and other application will most often have complex shapes which will therefore mechanically interlock them. Full alloying of the entire first layer is avoided by choice and quantity of layer materials since this would upset the fidelity of the first layer. But the fusible layer must be present in sufficient quantity to provide material which can in fact melt prior to alloying. That is, if the fusible layer is applied in insufficient quantity, upon heating only interdiffusion will take place and there will be no melting whereupon the objects of our invention would not be fulfilled.

In certain instances it will not be necessary to heat up to the melting point of the lower melting point layer to achieve fusion. For instance, if the adjacent layers are chosen so that a eutectic results between the two constituents it may be found that it is not necessary to go even up to the melting point of the intermediate layer, although it probably will be desirable as a practical matter.

To discuss another aspect of the method, on one hand it is desirable to heat treat the object above the maximum temperature it will see during HIP. This could be accomplished by giving the aforementioned nickel-copper-nickel structure a 1250° C. heat treatment following the nominal 1125° C. treatment. But, on the other hand, for certain objects it will be undesirable to have the heat treatment so high, since deformation may result as the non-melting layers weaken at higher temperatures. For such objects, the fusion which is achieved in the processing at the lower temperature will be sufficient to make the container impermeable at the temperatures at which it is filled and evacuated. Upon heating in the HIP unit, if a higher temperature is encountered than has been encountered during the fusion step, there may be some further remelting of the lower melting or alloyed layers. However, this is not of itself a problem since any liquid is contained within the inner and outer layers and the pores in the inner layer are of such a fine nature that even under the high pressures of the HIP process it is found that an adequate gas seal will be provided. In contrast to the situation before HIP, the container will be supported in relative shape during HIP by the contained powder, although it will be of course gradually contracting due to the applied pressure. Naturally, further alloying, diffusion and resolidification will take place. In practice, given that the preferred heat treatments comprise several hours and engender diffusion, remelting of the center layer during HIP has not been verified and can only be speculated about. In any event, the aforementioned lower temperature processing is found effective for the HIP objects of the invention, despite the fact that higher temperatures are encountered in HIP use compared to those in the heat treatment.

Thus, to generally state the case where the HIP container is not heated above its use temperature during the heat treatment, it may be said that the heat treatment at a first temperature causes melting and fusion of a portion of the layered structure, to provide impermeability while the non-melting layers provide structural support. Then the container is filled with powder and evacuated. Thus the sought-for relative distribution of material within the object is now fixedly determined. Next the powder filled container is heated during HIP to a second higher temperature. Further melting and alloying take place and the non-melting layers are weakened. But the container remains impermeable due to the meltable layer, while the relative dimensions of the object are maintained since the powder and now-weakly flexible container are self-supporting under the HIP pressure. With sustained temperature and pressure, the container and powder are gradually deformed and compacted as desired.

The invention may be further illustrated and understood by the following examples of other combinations of materials which are suited for making impermeable structures and containers for various purposes in addition to HIP consolidation of nickel superalloy powders:

EXAMPLE 1

A 1 mm first layer of nickel is electrodeposited unto a conductive wax mandrel. A second layer of about 0.1 mm gold is electroplated upon the nickel using a conventional cyanide type bath. A 1 mm third layer of nickel is applied. The three layer electrodeposit is removed from the mandrel and heated to about 1050°-1075° C. for about 0.5 hours to melt the gold and form an impermeable container. Extensive initial alloying and melting will take place as 7-27% gold-nickel has a melting point below 1000° C. Solidification will occur as interalloying occurs, and gold content falls, thereby raising the interfacial melting point.

EXAMPLE 2

Substantially the same procedure is followed as in Example 1 except that tin about 0.2 mm thick is substituted for gold, the tin being deposited by electroplating from an acid type bath. After formation of the metal structure, the electrodeposit is heated to about 1000° C. to melt the tin and form an impermeable object. As the tin melts around 250° C. melting and interalloying readily occur.

EXAMPLE 3

A 1 mm thick layer of cobalt is electrodeposited on a conductive wax mandrel using a sulfamate type bath followed by an electrodeposit of 0.1 mm gold using a gold cyanide bath. This is followed by a further 1 mm thick cobalt layer. The electrodeposit is removed from the mandrel and heated to a temperature of about 1050° C. for a period of about 3 hours. It is found that the cobalt and gold will alloy and a fused container will result.

EXAMPLE 4

A 1 mm layer of nickel is electrodeposited on a mandrel, followed by a 0.2 mm layer of copper. The electrodeposit is removed from the mandrel and heated at 1000°-1200° C. for two hours. Then the article is cooled and an additional 1 mm layer of nickel is plasma sprayed on the outer fused surface to provide structural support.

Although this invention has been shown and described with respect to a preferred embodiment thereof, it should be understood by those skilled in the art that various changes and omissions in the form and detail thereof may be made therein without departing from the spirit and scope of the invention.

Having thus described a typical embodiment of our invention, that which we claim as new and desired to secure by Letters Patent of the United States is:

1. The method of forming an impermeable free-standing metal structure from deposited metals which comprises:

providing a pattern with a conductive surface;

depositing a first metal layer with a first melting point on the pattern surface;

depositing a second metal layer having a second melting point upon the first layer to create a two-layer metal structure, the layers having the capability of alloying;

removing the pattern from the metal structure;

heating the metal structure to a temperature of at least 1100° C. to melt at least a portion of one of the layers, the other layer remaining substantially unmelted to provide structural support for the metal structure, to maintain its shape during heating; and cooling the structure to solidify the melted layer and thereby make the structure impermeable to gases at pressure of the order of 100 MPa.

2. The method of forming an impermable free-standing metal structure from deposited layers which comprises providing a pattern with a conductive surface;

depositing a first metal layer with a first melting point on the pattern surface;

depositing a second metal layer, having a second melting point upon the first layer;

depositing a third metal layer having a third melting point upon the second layer, wherein the first and third melting points are higher than the second melting point, thereby forming a three-layer metal part which is permeable to gases at pressure of the order of 100 MPa;

removing the pattern to produce a free-standing metal part consisting only of deposited layers;

heating the metal part comprised of the three layers to a temperature of at least 1100° C., sufficient to melt at least a portion of the second layer but insufficient to cause melting of at least a portion of one of the first or third layers, the melting in the second layer occurring at a temperature greater than 1100° C. and causing a degree of alloying between at least two of the adjacent layers, and the unmelted portions thereby maintaining the shape of the part; and then cooling the part to solidify the melted portions, to make it impermeable to gases at pressures of the order of 100 MPa.

3. The method of claims 1 or 2 wherein the first and third layers are formed of identical material and are about the same thickness.

* * * * *